US006245223B1

(12) United States Patent
Gorbaty et al.

(10) Patent No.: US 6,245,223 B1
(45) Date of Patent: Jun. 12, 2001

(54) SELECTIVE ADSORPTION PROCESS FOR RESID UPGRADING (LAW815)

(75) Inventors: Martin L. Gorbaty, Westfield; David T. Ferrughelli, Flemington; William N. Olmstead, Murray Hill; Sabato Miseo; Stuart L. Soled, both of Pittstown; Winston K. Robbins, New Providence, all of NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/568,865

(22) Filed: May 9, 2000

Related U.S. Application Data

(63) Continuation of application No. 09/263,037, filed on Mar. 5, 1999, now abandoned, which is a continuation-in-part of application No. 08/991,279, filed on Dec. 16, 1997, now abandoned.

(51) Int. Cl.[7] ..... C10G 25/00; C10G 25/05; C10G 25/12

(52) U.S. Cl. ..... 208/251 R; 208/253; 208/299; 208/305; 208/307; 585/820; 585/823; 585/826

(58) Field of Search ..... 208/251 R, 253, 208/299, 305, 307; 585/820, 823, 826

(56) References Cited

U.S. PATENT DOCUMENTS

| | | | | |
|---|---|---|---|---|
| 2,914,458 | * | 11/1959 | Harper | 208/88 |
| 2,987,470 | * | 6/1961 | Turken | 208/253 |
| 3,839,187 | * | 10/1974 | Vanvenrooy | 208/214 |
| 4,048,061 | * | 9/1977 | Blytas | 208/251 R |
| 4,116,820 | * | 9/1978 | Blytas | 208/251 R |
| 4,192,736 | * | 3/1980 | Kluksdahl | 208/251 H |
| 4,486,298 | * | 12/1984 | Bowes et al. | 208/253 |
| 4,549,958 | * | 10/1985 | Beck et al. | 208/253 |
| 4,915,820 | * | 4/1990 | Hettinger, Jr. | 208/253 |
| 5,110,480 | * | 5/1992 | Yan | 210/670 |
| 5,463,167 | * | 10/1995 | Ou | 585/823 |

* cited by examiner

*Primary Examiner*—Walter D. Griffin
(74) *Attorney, Agent, or Firm*—Ronald D. Hantman

(57) ABSTRACT

The present invention is a process to remove a major portion of metals and coke precursors from a hydrocarbon stream. The steps of the process include contacting the feedstream with a hydrocarbon insoluble adsorbent, recovering the oil which does not adsorb and removing the metals and coke precursors from the adsorbent.

15 Claims, 2 Drawing Sheets

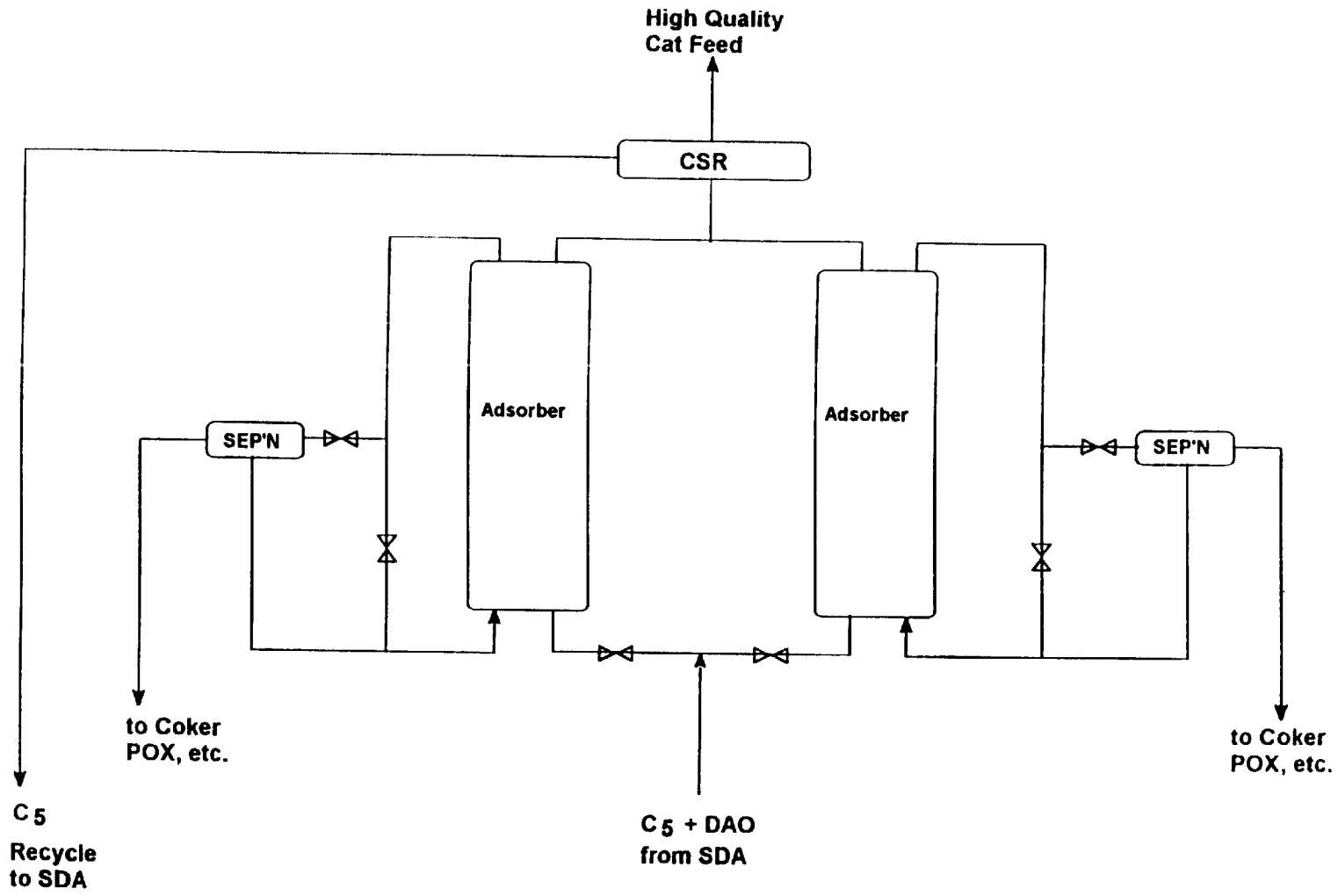
Figure 1. Process Scheme for SDA and Adsorption

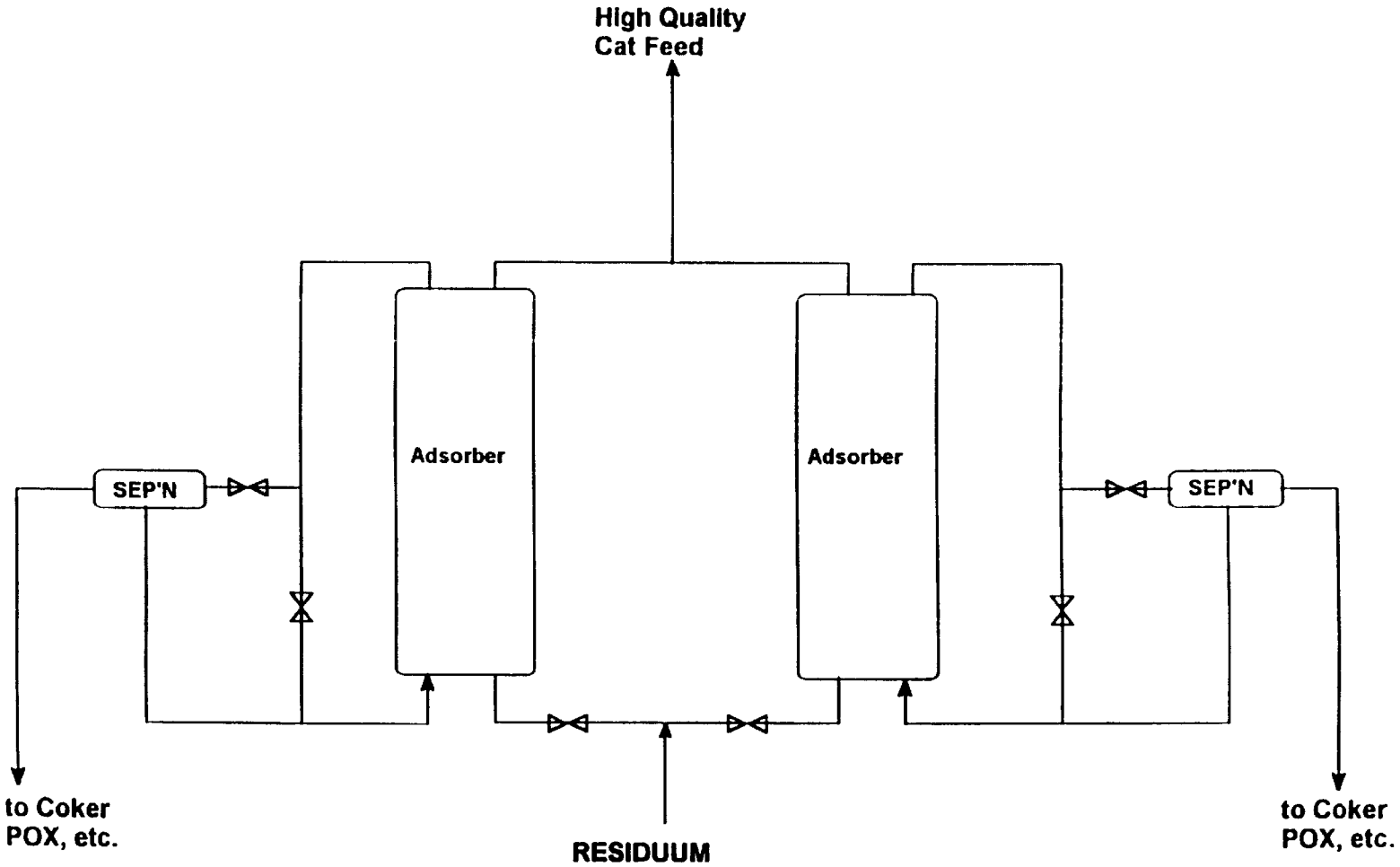
Figure 2. Process Scheme for Residuum Adsorption

SELECTIVE ADSORPTION PROCESS FOR RESID UPGRADING (LAW815)

CROSS-REFERENCE TO RELATED APPLICATION

This Application is a Rule 1.53(b) Continuation of U.S. Ser. No. 09/263,037 filed Mar. 5, 1999, now abandoned, which is a continuation-in-part of U.S. Ser. No. 08/991,279, filed Dec. 16, 1997, now abandoned.

BACKGROUND OF THE INVENTION

The present invention relates to the refining of hydrocarbon feedstocks. More particularly, this invention concerns the segregation and removal of coke precursors and metals from atmospheric and vacuum residua, and deasphaltened atmospheric and vacuum residua.

Hydrocarbon feedstocks, whether derived from natural petroleum or synthetic sources, are composed of hydrocarbons and heteroatom containing hydrocarbons which differ in boiling point, molecular weight and chemical structure. High boiling, high molecular weight heteroatom-containing hydrocarbons (e.g. asphaltenes) are known to contain a greater proportion of metals and carbon forming constituents (i.e. coke precursors) than lower boiling naphtha and distillate fractions. Because coke precursors form coke during thermal processing (such as is employed in a modem refinery), it is desirable to remove (or at least segregate) the heteroatom containing hydrocarbons containing the metals and coke precursors, thereby facilitating further processing of the more valuable fractions of the feedstock.

Removing coke precursors and metals from a hydrocarbon feed is not new. Long (U.S. Pat. No. 4,624,776) describes a process where resid is contacted with an adsorbent, the adsorbent is contacted with solvent having certain solubility characteristics to desorb part of the feed that is depleted in coke precursors, and then the adsorbent is contacted with a second solvent with different solubility characteristics to desorb a second portion of the feed that is enriched in coke precursors. Bowes (U.S. Pat. No. 4,486,298) describes a demetallation process where an aromatic solvent, such as benzene, or cyclic, non-aromatic solvent, such as cyclohexane, is required to be added to the feed in order to disperse the metal containing compounds. The mixture is then contacted with an adsorbent to remove a major portion of the metal containing compounds. In the present invention, a feed, either resid or the deasphalted oil from a solvent deasphalting unit, containing coke precursors and metal containing compounds is contacted with an adsorbent without the need for additional solvent

SUMMARY OF THE PRESENT INVENTION

Accordingly, the present invention is a process to remove a major portion of metals and coke precursors from a hydrocarbon or heteroatom-containing hydrocarbon feedstream. The feedstream is contacted with an adsorbent that adsorbs the metals and coke precursors. Additional solvent is not required. The feedstream effluent is transferred to another vessel. The metals and coke precursors are then removed from the adsorbent by a suitable solvent.

In one preferred embodiment, the feedstream is from a solvent deasphalter. Feed from a deasphalter includes a paraffinic solvent such as propane, butane or pentane. In another embodiment the feedstream is residuum from either atmospheric or vacuum distillation. Residuum is defined as that material which does not distill at a given temperature and pressure. Atmospheric resid is that fraction of crude petroleum which does not distill at 300° C. at atmospheric pressure. Atmospheric resid is further fractionated under vacuum and that fraction which does not boil at greater than 500° C. (atmospheric pressure) is called vacuum residuum.

BRIEF DESCRIPTION OF THE DRAWINGS

FIG. 1 shows a schematic diagram of the process of one embodiment of the present invention, illustrating how metals and coke precursors would be removed from deasphaltened oil (DAO), the product from a solvent deasphalter.

FIG. 2 shows a schematic diagram of another embodiment of the present invention illustrating upgrading a residuum from either atmospheric or vacuum distillation.

DESCRIPTION OF THE PREFERRED EMBODIMENT

The present invention is an adsorption process to remove a significant amount of metals and coke precursors from a hydrocarbon feedstream, and to render that stream more valuable as a fuel or as feed to a catalytic cracker. Any hydrocarbonaceous liquid containing metals and coke precursors, regardless of source, may be used for the feedstream of this invention. These may include atmospheric and vacuum residua, vacuum gas oils, solvent deasphalting (SDA) fractions with and without resins, and even whole crude oils, particularly those containing high levels of nickel and vanadium such as found in Venezuela tars for example. While any of these liquids may be used as a feedstock if the results are economically justified, particularly useful feedstreams for this invention are atmospheric and vacuum residua. The effluent from the process will then provide a clean cat cracker feed. The adsorption process uses a hydrocarbon insoluble adsorbent material, which has a high capacity for adsorbing metals and coke precursors, and which can be easily regenerated by washing with relatively polar solvents or solvent mixtures, or by other processes including those with pyrolysis or combustion steps.

FIG. 1 shows a schematic diagram of one embodiment of the process of the present invention aimed at upgrading a solvent deasphalted heavy oil. In the figure, the effluent from a solvent deasphalter (SDA), composed of a deasphaltened oil (DAO) in about 4–6 volumes of deasphalting solvent, such as propane, butane, or pentane at about 120–160° C. is passed into a vessel containing the adsorbent. The vessel can be configured as a fixed bed, ebullating bed or slurry bed. After contacting for an appropriate time, the reactor effluent is transferred to another vessel labeled "CSR", where the deasphalting solvent (e.g., pentane) is removed and recycled to the SDA, while the product, an upgraded deasphaltened oil, is an acceptable cat cracker feed (<about 4 ppm metals and <about 4 wt % coke precursors). The upgraded deasphaltened oil is sent to a cat cracker to be fed directly or blended with conventional vacuum gas oil (VGO). The swing reactor configuration in FIG. 1 is set up such that one vessel is set up for adsorption, while the other is set up for adsorbent regeneration. In the Figure, regeneration is carried out by using solvents such as toluene, toluene-methanol, or other appropriate solvents available in a refinery environment. The metal containing and coke precursor molecules are washed off the adsorbent, the solution containing these impurities is stripped in the box labeled "SEP'N", the solvent recycled and the impurities stream sent to a coker, partial oxidation unit or other disposal technique.

FIG. 2 shows a schematic diagram of a second embodiment of the process of the present invention aimed at upgrading a residuum from either atmospheric or vacuum distillation. In the Figure, the residuum is passed into a vessel containing the adsorbent. The vessel can be configured as a fixed bed, ebullating bed or slurry bed. All of these beds are well-known in the art, see O. Levenspiel, *Chemical Reaction Engineering,* 2nd Edition, Wiley, New York (1972) and *Fluidization Engineering,* Krieger, New York (1977). After contacting the adsorbent for an appropriate time, the effluent is an upgraded residuum with lowered metals and coke precursor content. The upgraded residuum flows on to further refining processing, such as cat cracking, where it is treated either directly or blended with other refinery streams, such as conventional vacuum gas oil (VGO). The swing reactor configuration in FIG. 2 is set up such that one vessel is set up for adsorption, while the other vessel is set up for adsorbent regeneration. In the Figure, regeneration is carried out by using solvents such as toluene, toluene-methanol, or other appropriate solvents available in a refinery environment. The metal containing and coke precursor molecules are washed off the adsorbent, the solution containing these impurities is stripped in the box labeled "SEP'N", the solvent is recycled and the impurities stream sent to a coker, partial oxidation unit or other disposal technique.

Suitable adsorbents for the present process include hydrocarbon insoluble inorganic and carbonaceous materials, which have surface areas greater than 100 $m^2/g$ and whose surfaces may be acidic. Specific examples of adsorbents useful for this process include silica, silica-alumina, K-10 and similar acid-treated clays and activated carbons, with surface areas <1000 $m^2/g$. A preferred feedstream to adsorbent ratio is between 0. land 10 wt/wt.

The present invention shall be illustrated by examples using feedstreams of Arabian Light atmospheric residuum, effluent from solvent deasphalters and various acceptable adsorbents and process solvents.

I. Arabian Light Atmospheric Residuum (ALAR)

ALAR is one example of a feedstream suitable for the present process. In this protocol, an Arabian Light atmospheric residuum, (ALAR), was combined with a solvent and adsorbent (ratio of 4 solvent: 1 adsorbent: 1 oil), held at room temperature for 16 hrs. Solvents were used in the room temperature experiments in order to keep the viscosity within a workable range. At elevated temperatures (e.g., 200° C. ) solvents are not necessary for the contacting of oil with adsorbent. Following filtration, the solvent was removed on a rotary evaporator yielding a clean oil. The adsorbed material was treated first with toluene, then a 1:1 (by volume) toluene:methanol mixture to desorb it from the adsorbent. Data in Table 1 show that, compared to starting ALAR, the product oils treated by the method of this invention contained very low levels of metals and showed a significant enough reduction of coke precursors as measured by the decrease in % CCR such that the product could be fed directly to a cat cracker. Among the adsorbents used include silica, calcined at 600° C. It has a surface area of 300 $m^2/g$ and a reported pore diameter of 150 A. Another is amorphous silica-alumina (87 wt % silica), whose surface area and pore diameter are 318 $m^2/g$ and 105 A respectively.

TABLE 1

ARABIAN LIGHT ATMOSPHERIC RESID (ALAR) MADE INTO ACCEPTABLE CAT CRACKER FEED STOCK BY ADSORPTION

| | % TOLUENE SOLUBLES | % CCR | Ppm VANADIUM | ppm NICKEL | ppm IRON |
|---|---|---|---|---|---|
| A. L. 650+ ° F. | 100 | 9.0 | 39 | 11 | 7 |
| 7% C5 INSOL. | — | 56.0 | | | |
| 93% C5 SOL. | — | 5.9 | | | |
| SILICA (G-62) PRODUCT | 93.5 | 6.4 | 15 | 5.8 | 0 |
| Si/Al (MS-13) PRODUCT | 90.0 | 4.2 | 2 | 4.8 | 0 |

EXAMPLE 1

General Procedure

A mixture of one part by weight oil, 4 parts by weight solvent, and 1 part by weight adsorbent were combined and allowed to stir for 16 hours at room temperature. The adsorbent was separated by filtering through a medium porosity buchner funnel. The solvent was removed from the filtrate by roto-evaporation. The resulting oil was analyzed for %CCR and metals. The recovered adsorbent was treated with a 25% ethanol in toluene at reflux in a Soxhiet extractor, until no further color was released. The solvent was removed by roto-evaporation, and the residue analyzed for metals and CCR.

EXAMPLE 2

In a 250 ml round bottom flask, 7.0 g of Arabian Light Atmospheric residuum was combined with 28 ml of toluene. The mixture was stirred for 2 hours, and 7.0 g of silica, Grade G-62 from Grace-Davison, previously calcined at 600° C., was added, and the mixture stirred for 16 hours at room temperature. The mixture was filtered through a course filter funnel, the toluene evaporated and the recovered oil (6.58 g; representing 94% of the starting oil) was sent for metals and CCR analyses. Analyses are shown in Table 1.

EXAMPLE 3

In a 250 ml round bottom flask, 6.88 g of Arabian Light Atmospheric residuum was combined with 28 ml of toluene. The mixture was stirred for 2 hours, and 6.88 g of a silica-alumina material, designated MS—13 (containing 13% alumina) from Grace-Davison, previously calcined at 600° C., was added, and the mixture stirred for 16 hours at room temperature. The mixture was filtered through a course filter funnel, the toluene evaporated and the recovered oil (6.19 g; representing 90% of the starting oil) was sent for metals and CCR analyses. Analyses of the recovered oil are shown in Table 1.

EXAMPLE 4

This example illustrates adsorbent regeneration by heating. The filtered solid from Example 3 was heated to 490°

C. for 2 h under flowing nitrogen, cooled to room temperature and the adsorption experiment described above repeated using this solid. The recovered oil (90% of starting oil) had a CCR of 4.8% and contained 4.0 ppm V and 3.0 ppm Ni.

EXAMPLE 5

In a 250 ml round bottom flask, 7.5 g of Arabian Light Atmospheric residuum was combined with 30 ml of cyclohexane. The mixture was stirred for 2 hours. 7.5 g of silica, Grade G-62 from Grace-Davison, was added and stirred at room temperature for 16 hours. The mixture was filtered through a course filter funnel, the cyclohexane evaporated and the recovered oil (6.21 g; representing 83% of the starting oil) The treated oil had a CCR of 3.0% and contained<1 ppm V and 2 ppm Ni.

EXAMPLE 6

In a 250 ml round bottom flask, 7.0 g of Arabian Light Atmospheric residuum was combined with 30 ml of cyclohexane. The mixture was stirred for 2 hours, and 7.0 g of a silica-alumina material designated MS-13 (containing 13% alumina) from Grace-Davison, previously calcined at 600° C., was added, and the mixture stirred for 16 hours at room temperature. The mixture was filtered through glass wool, the filter cake washed with about 200 ml cyclohexane, the cyclohexane was evaporated and the recovered oil (5.34 g; representing 76.3% of the starting oil). The treated oil had a CCR of 2.7% and contained 2 ppm V and 2 ppm Ni.

EXAMPLE 7

In a 250 ml round bottom flask, 7.0 g of Arabian Light Atmospheric residuum was combined with 28 ml of toluene. The mixture was stirred for 2 hours, and 7.0 g of Norit activated carbon was added, and the mixture stirred for 16 hours at room temperature. The mixture was filtered through a course filter funnel, the toluene evaporated and the recovered oil (85% of the starting oil) was shown to contain lppm V and 4 ppm Ni. The CCR decreased to 2.7 from 9.0%.

EXAMPLE 8

This example illustrates adsorbent regeneration by heating. The filtered solid from Example 7 was heated to 490° C. for 2 h under flowing nitrogen, cooled to room temperature and the adsorption experiment described above repeated using this solid. The recovered oil (89% of starting oil) had a CCR of 3.9% and contained 3.0 ppm V and 2.0 ppm Ni.

EXAMPLE 9

The example illustrates the process without use of a solvent. In a 200 ml round bottom flask, 60.0 g of Arabian Light Atmospheric residuum was heated to 200° C. with stirring and 30 g of a silica-alumina material designated MS-13 (containing 13% alumina), previously calcined at 600° C., was added. The mixture was stirred for 16 hours at 200° C. The oil was decanted from the solids and analyzed. The treated oil had a CCR of 4.7% and contained 1 ppm V and 1 ppm Ni.

EXAMPLE 10

A fresh sample of 7.4 g of Heavy Arab Vacuum Resid (975° F+) containing a % CCR of 22.1%, 55 ppm Ni, and 190 ppm V was mixed with 30 ml o-xylene and heated to 100° C. at which time 12 g of calcined (600° C.) silica was added. The mixture was brought to 140° C. and refluxed for 6 hours. The solvent was then removed by roto-evaporation and 100 ml pentane was added to the flask and stirred for 16 hours at 25° C. The mixture was then filtered and the pentane removed by roto-evaporation to recover the pentane soluble oil (64.4%). The DAO had a % CCR of 5.01% and contained 3 ppm Ni and <1 ppm V. The pentane insoluble oil (35.6%) was removed from the adsorbent with a 25% methanol/75% toluene mixture.

II. Effluent from Solvent Deasphalter (SDA)

SDA also provides a feedstream for the present process. Solvent deasphalting (SDA) is another way of separating metals and coke precursors from residua. There is a trade-off between the yield and the levels of "impurities" remaining in the deasphaltened oil (DAO). The higher the yield of DAO, the higher the impurity levels. The yield and cleanliness of DAO defined the economic limit of how much deasphalting can be done. For example, using n-pentane approximately 75% yield of DAO can be obtained from a Baytown vacuum residuum. However, this DAO contains about 11% Conradson carbon and about 70 ppm of metals. This DAO would not be suitable as a cat cracker feed stock, and were it to be fed to a cat cracker, it could only be done in very small amounts to avoid catalyst poisoning and too much coke make. Alternately, by using propane or butane in SDA, a good quality cat cracker feed stock can be obtained but in yields between 35–50%. This has the effect of limiting the amount of resid cat cracking possible by using SDA. The present process provides a simple way to clean up the DAO after SDA, or the feed to SDA, or to isolate the impurities during SDA, which would remove the bottleneck and allow the use of SDA to produce high yields of DAO as cat cracker feed stock, leading to more resid conversion.

The effluent from SDA, composed of a DAO in about 4–6 volumes of pentane, for example, at about 120–160° C. is passed into a vessel containing the adsorbent. After contacting for an appropriate time, the reactor effluent is transferred to another vessel labeled "CSR" where the pentane is removed and recycled to the SDA process, while the product, now an acceptable cat cracker feed (<4 ppm metals and <4 wt % coke precursors) is sent to a cat cracker to be fed directly or blended with conventional VGO (see FIG. 1).

The adsorbents used include silica, calcined at 600° C. It had a surface area of 300 $m^2/g$ and a reported pore diameter of 150 A. Another is amorphous silica-alumina (87 wt % silica), whose surface area and average pore diameter were determined to be 318 $m^2/g$ and 105 A respectively. Data for calcined silica are shown in the attached Table 2, along with a non-limiting experimental protocol. In this protocol, a DAO was combined with a solvent (ratio of 4 parts solvent: 1 DAO), heated to temperature, and the adsorbent added at a treat rate of 2:1 adsorbent to feed oil. The mixture was held at temperature for 6 hours, and cooled to room temperature. The solvent was removed on a rotary evaporator, then 10 volumes of pentane were added, and the mixture stirred overnight. Following filtration, the pentane was removed on a rotary evaporator yielding a clean DAO. The pentane insoluble material was treated first with toluene, then a 1:1 (by volume) toluene:methanol mixture. Data in the table show that, compared to starting DAO, the product oils treated in the presence of solvent contained very low levels of metals and showed a significant reduction of coke precursors as measured by the decrease in % CCR (Conradson Carbon Residue).

TABLE 2

EXPERIMENT: DAO + SOLVENT + SILICA $\xrightarrow[6\ hr]{140^\circ C.}$ $\xrightarrow[95^\circ C.]{roto\ evap.}$ $\xrightarrow[25^\circ C.]{C_5}$ $\xrightarrow{Filter}$

SOLVENT:SILICA:DAO = 4:2:1

| SOLVENT | TEMP. ° C. | % C5 SOLUBLES | % MCR | ppm Ni | Ppm V | % C | % H | % N | % S | H/C |
|---|---|---|---|---|---|---|---|---|---|---|
| None | — | 100 | 10.75 | 20.3 | 49.9 | 84.53 | 11.19 | 0.31 | 3.95 | 1.58 |
| XYLENE | 140 | 77 | 4.5 | 0.8 | 0.5 | 85.18 | 11.62 | 0.16 | 2.92 | 1.64 |
| NONANE | 140 | 72 | 5.0 | 1.0 | 0.5 | 84.88 | 11.75 | 0.15 | 3.09 | 1.66 |
| HEPTANE | 100 | 70 | 5.0 | <1.0 | 0.3 | 84.99 | 11.83 | 0.00 | 3.19 | 1.67 |

EXAMPLE 11

General Procedure

A wt % mixture of one part oil, 4 parts solvent and 2 parts adsorbent were refluxed at 140° C. for 6 hours. The solvent was removed by roto-evaporation. Pentane was added in a ratio of 10:1 (solvent to oil) and the mixture was stirred for 16 hours. The pentane soluble oil was separated by filtering through a medium porosity buchner funnel. The pentane was removed from the filtrate by roto-evaporation. The resulting oil was analyzed for % CCR and metals. The pentane insoluble portion of the oil was removed from the adsorbent by treating with a more polar solvent or solvent mixture in a ratio of 10:1 (solvent:oil). The mixture was filtered and the pentane insoluble oil was recovered after roto-evaporation of the solvents. Analyses of the resulting oils are shown in Table 2.

EXAMPLE 12

A mixture of one part (7 g) Baytown DAO (11% CCR, 50 ppm V, 20 ppm Ni) and 4 parts (28 g) o-xylene was heated to 100° C. at which time 2 parts (12 g) silica (previously calcined at 600° C.) was added. The mixture was brought to 140° C. and refluxed for 6 hours. The solvent was removed by roto-evaporation and pentane was added in a ratio of 10:1 (solvent to oil) and allowed to stir at 25° C. overnight. The mixture was filtered and the pentane was removed by roto-evaporation to recover the pentane soluble fraction (77%). The resulting oil had a >50% reduction in % CCR and was virtually metal free (see Table 2).

The pentane insoluble oil was removed from the silica by stirring overnight at 25° C. in a mixture of 25% methanol/75% toluene and filtering to recover the pentane insoluble oil (23%) and regenerated adsorbent.

EXAMPLE 13

This example illustrates that regenerated inorganic adsorbents can be effectively used. A fresh sample of one part (7 g) Baytown DAO and 4 parts (28 g) o-xylene were heated to 100° C. at which time 2 parts (11.8) of the regenerated but not re-calcined silica from Example 12 was added. The mixture was brought to 140° C. and refluxed for 6 hours. The workup was as described in Example 12. The resulting oil (80%) had a % CCR of 4.7% and contained <1.5 ppm Ni and <0.33 ppm V.

EXAMPLE 14

A fresh sample of one part Baytown DAO (see Example 12) and 4 parts nonane were heated to 100° C. at which time 2 parts silica (Example 12) was added. The mixture was brought to 140° C. and refluxed for 6 hours. The workup was as described in Example 12. The resulting oil had a reduced % CCR and was virtually metal free (see Table 2).

EXAMPLE 15

A fresh sample of one part Baytown DAO (see Example 12) and 4 parts heptane were heated to 100° C. at which time 2 parts silica (Example 12) was added. The mixture was refluxed at 100° C. for 6 hours. The workup was as described in Example 12. The resulting oil had a reduced % CCR and was virtually metal free (see Table 2).

EXAMPLE 16

In this example another experimental protocol is illustrated. In this procedure, the deasphalting and adsorption are combined into one step. A fresh sample of one part Baytown DAO (see Example 12) and 10 parts pentane was stirred at 25° C. for 30 minutes. At this time 2 parts of silica (calcined at 600° C.) were added with continued stirring. The mixture was stirred for an additional 16 hours at room temperature. The pentane soluble oil was then recovered by filtration as in Example 12. The resulting oil (70%) had a % CCR of 5.1% and contained <2 ppm Ni and <0.75 ppm V.

EXAMPLE 17

A fresh sample of one part Baytown DAO (see Example 12) and 10 parts pentane was stirred at 25° C. for 30 minutes. At this time 2 parts of calcined (6000) silica (87%)/alumina (13%) was added with continued stirring. The mixture was stirred for an additional 16 hours at room temperature. The pentane soluble oil was then recovered by filtration as in Example 12. The resulting oil (58%) had a % CCR of 3.63% and contained <3 ppm Ni and <0.2 ppm V.

EXAMPLE 18

A fresh sample of one part Baytown DAO (see Example 12) and 4 parts o-xylene were heated to 100° C. at which time 2 parts of an uncalcined silica (87%)/alumina (13%) mixture was added. The mixture was brought to 140° C. and refluxed for 6 hours. The workup was described in Example 12. The resulting oil (69%) had a % CCR of 3.19% and contained <3.0 ppm Ni and <0.5 ppm V.

EXAMPLE 19

A fresh sample of one part Baytown DAO (see Example 12) and 4 parts toluene was prepared at which time 1 part of Norit activated carbon was added. The mixture was stirred at room temperature for 16 h. The workup was described in Example 12. The resulting oil (85%) had a % CCR of 6.5% and contained 1.0 ppm Ni and 7 ppm V.

What is claimed is:

1. A process to remove a major portion of metal-containing molecules and coke precursor molecules from a hydrocarbon feedstream including an atmospheric residuum, vacuum residuum, or a deasphalted oil from a solvent deasphalter, in the substantial absence of an added aromatic or cyclic non-aromatic solvent, comprising:

(a) contacting said hydrocarbon feedstream with a hydrocarbon insoluble adsorbent characterized by a surface area greater than $100m^2/g$ for a time and temperature sufficient to adsorb a major portion of said metal containing molecules and coke precursor molecules onto said adsorbent, (b) recovering the oil which does not adsorb and (c) removing the metal containing molecules and coke precursor molecules from said adsorbent.

2. The process of claim 1 wherein said removing step is carried out by contacting said adsorbent with a solvent capable of dissolving polar hydrocarbons.

3. The process of claim 1 wherein said adsorbent is selected from the group consisting of silica, silica-alumina, acid treated clays and activated carbons.

4. The process of claim 1 wherein the hydrocarbon feedstream is an atmospheric residuum having a boiling point greater than 300° C.

5. The process of claim 1 wherein said hydrocarbon feedstream is a vacuum residuum having a boiling point of 500° C. or greater at atmospheric pressure.

6. The process of claim 1 wherein said hydrocarbon feedstream is effluent from a solvent deasphalter which includes a propane solvent.

7. The process of claim 1 wherein said hydrocarbon feedstream is effluent from a solvent deasphalter which includes a butane solvent.

8. The process of claim 1 wherein said hydrocarbon feedstream is effluent from a solvent deasphalter which includes a pentane solvent.

9. The process of claim 1 wherein said removing step is carried out by contacting said adsorbent with heat.

10. The process of claim 1 wherein said feedstream and said adsorbent are present in a ratio between 0.1 and 10 wt/wt.

11. The process of claim 1 wherein said feedstream is fed through a fixed bed of adsorbent.

12. The process of claim 11 further comprising the step of terminating the feeding of the feedstream and regenerating said adsorbent by passing a solvent through said adsorber.

13. The process of claim 1 wherein said feedstream is a residuum and said temperature is greater than 150° C.

14. The process of claim 1 wherein said feedstream is a residuum and said temperature is between 200 and 225° C.

15. The process of claim I wherein said feedstream is a deasphalted oil from a solvent deasphalter and said temperature is between 140 and 160° C.

* * * * *